US007476292B2

(12) United States Patent
Ödmark

(10) Patent No.: US 7,476,292 B2
(45) Date of Patent: Jan. 13, 2009

(54) METHOD AND APPARATUS FOR USE WITH A TWIN-WIRE PRESS

(75) Inventor: Leif Ödmark, Matfors (SE)

(73) Assignee: Metso Paper, Inc. (FI)

( * ) Notice: Subject to any disclaimer, the term of this patent is extended or adjusted under 35 U.S.C. 154(b) by 472 days.

(21) Appl. No.: 10/554,452

(22) PCT Filed: May 5, 2004

(86) PCT No.: PCT/SE2004/000684

§ 371 (c)(1),
(2), (4) Date: Oct. 25, 2005

(87) PCT Pub. No.: WO2004/099494

PCT Pub. Date: Nov. 18, 2004

(65) Prior Publication Data

US 2006/0254739 A1 Nov. 16, 2006

(30) Foreign Application Priority Data

May 6, 2003 (SE) ..... 0301307

(51) Int. Cl.
*D21F 1/80* (2006.01)

(52) U.S. Cl. ..... 162/203; 162/211; 162/301; 162/351

(58) Field of Classification Search ..... 162/203, 162/207–211, 297, 300, 301, 351, 352; 210/400, 210/401

See application file for complete search history.

(56) References Cited

U.S. PATENT DOCUMENTS

| | | | | | |
|---|---|---|---|---|---|
| 3,847,731 | A | * | 11/1974 | Arledter | 162/203 |
| 4,235,667 | A | * | 11/1980 | Bergstrom et al. | 162/203 |
| 4,874,468 | A | | 10/1989 | Sbaschnigg et al. | |
| 5,489,365 | A | * | 2/1996 | Wahlstrom | 162/301 |
| 5,647,958 | A | * | 7/1997 | Schmidt-Rohr et al. | 162/203 |

* cited by examiner

*Primary Examiner*—Eric Hug
(74) *Attorney, Agent, or Firm*—Lerner, David, Littenberg, Krumholz & Mentlik, LLP

(57) ABSTRACT

A method for dewatering a fiber suspension in a twin-wire press is disclosed including feeding the fiber suspension to an inlet end of an elongated dewatering space, dewatering the fiber suspension during displacement of the endless lower and upper wires which form the elongated dewatering space by flowing filtrate through the endless lower and upper wires, collecting the filtrate in outlet boxes, and adjusting the pressure differential between the elongated dewatering space and each of the upper and lower outlet boxes by controlling the counter-pressure applied to the filtrate flow on both sides of the endless upper and lower wires directly adjacent the inlet end of the dewatering space. A twin-wire press is also disclosed therein.

9 Claims, 2 Drawing Sheets

METHOD AND APPARATUS FOR USE WITH A TWIN-WIRE PRESS

FIELD OF THE INVENTION

The present invention relates to a method and device for use with a twin-wire press.

BACKGROUND OF THE INVENTION

Twin-wire presses for dewatering of fiber suspensions and forming a continuous web thereof are previously known. Dewatering of the pulp is usually from an inlet pulp concentration of from 3-8 percent by weight to outlet pulp concentrations of 30-50 percent by weight. According to the state of the art, such twin-wire presses comprises lower rolls, an endless lower wire running in a path around the lower rolls, upper rolls, and an endless upper wire running in a path around the upper rolls. The two wires co-operate with each other along sections of these paths that run substantially in parallel with each other for dewatering of the fiber suspension between the wires during displacement thereof. An inlet box provides for supply of the fiber suspension to a wedge-shaped dewatering space between the wires. The twin-wire press further comprises two dewatering tables supporting the respective wire in these sections of the path and forming the wedge-shaped dewatering space between the wires for initially pressing and dewatering the fiber suspension, whereby a web is formed between the wires, and a roll arrangement situated after the dewatering tables in those sections of the paths, as seen in the direction of movement of the wires, for finally pressing and dewatering the web between the wires, so that the web will obtain a desired dryness. By dewatering space is meant the section between the dewatering tables where dewatering occurs. Alongside the longitudinal direction of the wires, in the wedge-shaped dewatering space, there are perforated dewatering elements that are arranged against the wires outside the dewatering space, through which dewatered filtrate is lead away to upper and lower outlet boxes, respectively, arranged at the dewatering tables for receiving filtrate that flows from the dewatering space through the upper and lower wires, respectively. The dewatering elements which rest against the upper and lower wires, respectively, in the wedge zone constitute together an upper and lower dewatering surface, respectively, where each dewatering surface may be composed of one or more dewatering elements. Upper and lower outlet boxes may be divided into several chambers whereby a filtrate through the upper and lower dewatering surfaces, respectively, may be divided into partial filtrate in two or more chambers in respective outlet boxes.

A traditional dewatering space in a twin-wire press has a wedge-shape with a fixed design that is not changeable when the twin-wire press is in operation. The outlet boxes are not sealed, and thus work against atmospheric pressure. The geometry of the table and the pulp suspension flow creates the operating pressure difference over the wire that controls the dewatering. The wedge shape determines the pressure build-up in the twin-wire press, and the dewatering process is to a large extent dependant on the shape of wedge, which is difficult to change. Changes of the wedge-shape requires new, extensive settings of the dewatering tables, a change of side sealings to the dewatering tables, etc. Owing to the fact that the wedge-shaped dewatering space has its largest cross-sectional area adjacent the inlet box, and thus narrows linearly in the direction of movement of the web, a well adapted pressure difference, also called delta P, is not obtained over the wire in the area at the dewatering space inlet end, which results in a defective build-up of the fiber web. Small fibers accumulate closest to the wire surface, and create a layer which is difficult for the filtrate to penetrate. The problem is to create a geometry for the dewatering table that provides an optimal pressure difference for the most effective dewatering and formation of the fiber web. The dewatering first begins some distance inside the dewatering space in the position where a first dewatering element is located. The inlet box comprises extended sealing blades whose free ends are arranged against the insides of the wires in the dewatering space. The ends of the sealing blades terminate at a position usually situated about 100 mm in advance of the location of the first dewatering element, which results in a relatively extensive backward flowing leakage of thick, fiber-rich flow occurs on both sides of the wires, where the ends of the sealing blades terminate.

One of the objects of the present invention is to provide an easier and improved adjustment of the pressure levels, and thereby more favorable dewatering, over the whole length of the dewatering table in a twin-wire press without changing the geometry of the dewatering table. Another object is to minimize leakage of fibers, particularly at the inlet end of the dewatering space.

SUMMARY OF THE INVENTION

In accordance with the present invention, these and other objects have now been realized by the invention of a method for dewatering a fiber suspension in a twin-wire press, the method comprising feeding the fiber suspension to an inlet end of an elongated dewatering space defined by an endless lower wire and an endless upper wire, dewatering the fiber suspension in the elongated dewatering space during displacement of the endless lower and upper wires by forming a flow of filtrate from the elongated dewatering space through the endless lower and upper wires, collecting the filtrate in a pair of upper and lower outlet boxes, and adjusting the pressure differential between the elongated dewatering space and each of the pair of upper and lower outlet boxes by controlling the counter-pressure applied to the flow of filtrate on both sides of the endless upper and lower wires directly adjacent to the inlet end of the elongated dewatering space. Preferably, the method includes applying a counter-pressure to the flow of the filtrate at a plurality of separate locations along the elongated dewatering space. In a preferred embodiment, the method includes independently controlling the counter-pressure at the plurality of separate locations along the elongated dewatering space.

In accordance with the present invention, a twin-wire press has also been devised for accomplishing these objects. The twin-wire press for dewatering a fibrous suspension comprises an endless lower wire and an endless upper wire forming an elongated dewatering space including an inlet and for dewatering the fibrous suspension therebetween, an inlet box for applying the fiber suspension to the inlet end of the elongated dewatering space, a lower perforated dewatering element disposed adjacent to the lower wire on the outer surface thereof, an upper perforated dewatering element disposed adjacent to the upper wire on the upper surface thereof, a lower outlet box for receiving the filtrate flowing from the elongated dewatering space through the elongated lower wire, an upper outlet box for receiving the filtrate flowing from the elongated dewatering space through the elongated upper wire, and a pressure control device for controlling the counter-pressure in the upper and lower outlet boxes in order to adjust the pressure differential between the elongated dewatering space and both the upper and lower outlet boxes at the inlet end of the elongated dewatering space. In a preferred embodiment of the twin-wire press, the pressure control device comprises a filtrate outlet pipe for receiving the flow of the filtrate from the upper and lower outlet boxes and a spillway overflow disposed at a level above the elongated dewatering space in the filtrate outlet pipe. Preferably, the level of the spillway overflow is adjustable.

In accordance with one embodiment of the twin-wire press of the present invention, each of the upper and lower outlet boxes comprises a plurality of chambers for receiving separate portions of the filtrate. In a preferred embodiment, the twin-wire press includes a plurality of pressure control devices for independently controlling the counter-pressures for each of the plurality of the chambers. In another embodiment, the twin-wire press includes sealing blades extending from the inlet box directly adjacent to the upper and lower perforated dewatering elements including free ends arranged against the inside of the endless upper and lower wires whereby a first filtrate portion is removed from the elongated dewatering space to a one of the plurality of chambers of both the upper and lower outlet boxes.

The above objects are also achieved by a method for dewatering a fiber suspension in a twin-wire press according to the present invention, in which method the fibre suspension is fed to an oblong dewatering space defined by an endless lower wire and an endless upper wire of the twin-wire press, against which wires lower and upper perforated dewatering elements are arranged outside the dewatering space, and the fiber suspension is dewatered in the dewatering space during displacement of the wires, such that a flow of filtrate from the dewatering space through the wires and the perforated dewatering elements is formed, filtrate that flows from the dewatering space through the wires is collected in outlet boxes, and the pressure difference between the dewatering space and at least one outlet box is adjusted by controlling at least one counter-pressure that is applied on at least a part of the flow of filtrate.

By means of control of the pressure in the dewatering space in accordance with the present invention, the dewatering can be corrected without needing to change the geometry of the wedge-shaped dewatering space, desired basis weight of the fiber web can be maintained, and new settings of the dewatering tables need not be carried out. The present invention facilitates different pressures being obtained at different areas along the whole dewatering space, whereby a perfect pressure for the dewatering required can be achieved.

The build-up of the fiber web is improved, and the fiber web can be prepared in a desired way before the roll nips. The present invention makes it possible to decrease the pressure difference in a first section of the dewatering space such that the smaller fibers do not accumulate closest to the surface of the wire.

According to the present invention, the fiber suspension enters into the dewatering space through an inlet end. Preferably, the pressure difference is adjusted between the dewatering space and outlet boxes by control of at least a counter-pressure that is applied to at least a portion of the flow of filtrate. Suitably at least a counter-pressure is applied to the portion of the flow of filtrate that is formed on both sides of the lower and upper wires directly adjacent to the inlet end of the dewatering space, particularly in the area around the sealing blades. By inlet end of the dewatering space is meant the position where the dewatering space begins. The possibility of creating a first dewatering area with separate pressure control for separation of a first filtrate is particularly advantageous, because this first filtrate consists of a relatively thick, fiber-rich flow because the built-up of the fiber web does not begin until some distance into the dewatering space. Accordingly, fiber leakage at the dewatering inlet end can be minimized.

According to a preferred embodiment of the present invention it is possible to apply a plurality of separate counter-pressures on respective portions of the flow of filtrate, which are separated, whereby the pressure level over the whole length of the dewatering space can be optimally adjusted. Thus, the fiber web can be better prepared and controlled before the nips. The separate counter-pressures can suitably be controlled independently of each other for an optimal adjustment.

The present invention also relates to a twin-wire press for dewatering of a fiber suspension, comprising an endless lower wire and an endless upper wire, which defines an oblong dewatering space in which the fiber suspension will be dewatered during displacement of the wires, an inlet box for supplying the fiber suspension to the dewatering space, lower and upper perforated dewatering elements that are arranged against wires outside the dewatering space, a lower outlet box for receiving filtrate that flows from the dewatering space through the lower wire and lower perforated dewatering element, an upper outlet box for receiving filtrate that flows from the dewatering space through the upper wire and upper perforated dewatering element, and a pressure control device arranged to control one or more counter-pressures in the lower and upper outlet box, respectively, for adjustment of a pressure difference between the dewatering space and the outlet boxes.

The outlet boxes can be separated from each other whereby a pressure control device is arranged for each of the outlet boxes in order to be able to receive different counter-pressures in the outlet boxes. The pressure control device may, for example, be provided with a pump and a valve or the like, which facilitates that control of the pressure difference can be achieved between the dewatering space and the outlet boxes. According to a preferred embodiment of the present invention, the pressure control device comprises a filtrate outlet pipe connected to the outlet boxes, and a spillway overflow in the filtrate outlet pipe, whereby the spillway overflow is located at a level above the dewatering space. The level of the spillway overflow is suitably adjustable, and thus its height over the dewatering space can be changed, which means that the pressure difference can be adjusted optimally between the dewatering space and the outlet boxes.

As described above, according to a preferred embodiment of the present invention, at least a counter-pressure can be applied on both sides of the upper and lower wires directly adjacent to the inlet end of the dewatering space, in particular in the area around the sealing blades. In that respect, the twin-wire press comprises initial perforated dewatering elements arranged directly adjacent to sealing blades, which extend from the inlet box, whose free ends are arranged against the insides of the wire in the dewatering space, whereby a first partial filtrate is separated to a first chamber of a respective outlet box.

One or more upper and lower perforated dewatering elements forms an upper and lower dewatering surface, respectively. According to an embodiment of the present invention, the outlet boxes of the twin-wire press comprise two or more chambers for receiving a respective partial filtrate, which facilitates that the pressure level over the whole length of the dewatering space can be optimally controlled. Preferably, a plurality of separate pressure control devices can be arranged to control the counter-pressures in the chambers independently of each other.

The chamber, or those chambers that are arranged to use a counter-pressure, are sealed in order to operate above atmospheric pressure. In the case where the outlet boxes are divided into two or more chambers, the first chamber is the one that is arranged to receive filtrate from the first section of the dewatering space.

BRIEF DESCRIPTION OF THE DRAWINGS

The present invention will now be described in more detail in the following detailed description, with reference to accompanying drawings, without restricted interpretation of the invention thereof, where.

DETAILED DESCRIPTION

Figure 1:
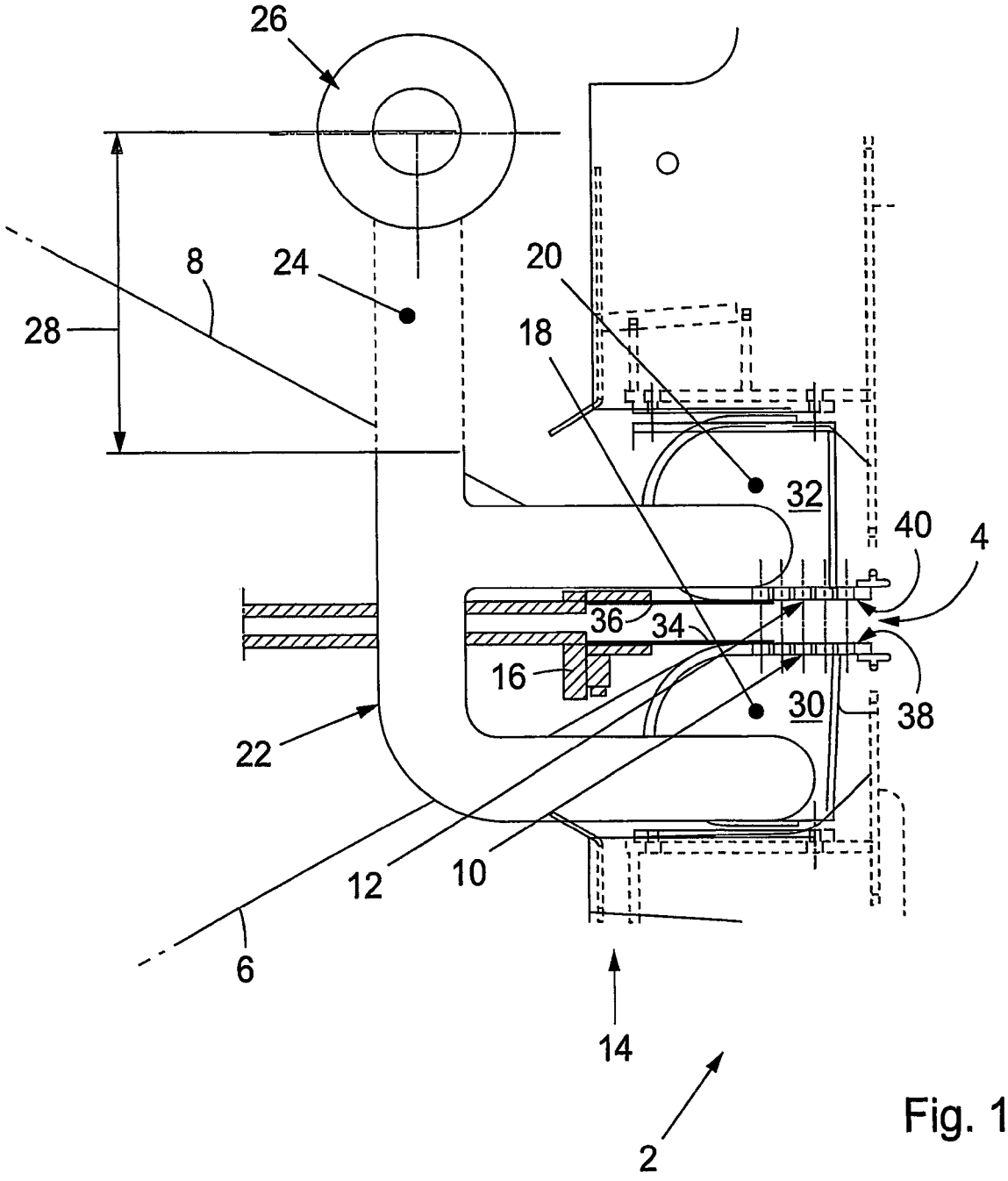
FIG. 1 is a side, elevational, schematic, partial cross-sectional view through a twin-wire press according to the present invention.

Referring to the drawings, FIG. 1 shows schematically a partial view through the twin-wire press 2 according to the present invention, more precisely a section at an inlet end 14 of a dewatering space 4 in the area at and around an inlet box 16. The fiber suspension that will be dewatered is supplied from the inlet box 16 to the dewatering space 4 defined by an endless lower wire 6 and an endless upper wire 8 during displacement of the wires, 6 and 8. Initial perforated dewatering elements, 10 and 12, are arranged outside the dewatering space. Such perforated dewatering elements are used over the entire length of the dewatering space for removal of filtrate from the dewatering space. The perforated dewatering elements, 10 and 12, shown in FIG. 1 are arranged at the inlet end 14, and are formed of a bent plate with holes therein, which replaces those rolls that are traditionally used at an inlet end of a twin-wire press. Filtrate flows through the wires, 6 and 8, from the dewatering space and is collected in outlet boxes, 18 and 20. The lower outlet box 18 receives filtrate that flows from the dewatering space through the lower wire 6 and lower dewatering element while the upper outlet box 20 receives filtrate that flows from the dewatering space through the upper wire 8 and upper dewatering element. A pressure control device 22 controls a counter-pressure in the lower and the upper outlet boxes, 18 and 20, respectively, and is arranged to adjust the pressure difference between the dewatering space and the outlet boxes, 18 and 20.

FIG. 1 shows a pressure control device 22 that comprises a vertical filtrate outlet pipe 24 connected to the outlet boxes, and a spillway overflow 26 in the filtrate outlet pipe, whereby the spillway overflow is located at a level 28 above the dewatering space 4. The level of the spillway overflow is thus the difference in height between the spillway overflow and the dewatering space. The filtrate outlet pipe 24 is arranged to be vertically displaceable, whereby the level 28 of the spillway overflow 26 relative to the dewatering space, and the outlet boxes therein, are adjustable. Thus, the pressure difference between the dewatering space 4 and the outlet boxes, 18 and 20, may easily be controlled by displacement of the filtrate outlet pipe 24 whereby the position of the spillway overflow 26 can be moved. In that respect, the filtrate outlet pipe 24 can, for example, be formed of a plurality of pipes telescopically arranged with respect to each other.

As is evident from FIG. 1, the present invention according to a preferred embodiment can comprise initial perforated dewatering elements, 10 and 12, arranged directly adjacent to sealing blades, 34 and 36, extended from the inlet box 16, whose free ends are arranged against an inside, 38 and 40, respectively, of the wires, 6 and 8, in the dewatering space, whereby a first filtrate is removed to a first chamber, 30 and 32, of the outlet boxes, 18 and 20, respectively.

Thus, each outlet box, 18 and 20, may comprise more than one chamber for receiving a partial filtrate, respectively, from the dewatering space 4, and the pressure control device 22 can be arranged to control the counter-pressures in the chambers independently of each other. Thus, the pressure control device 22 may, for example, be arranged to control the counter-pressure in the chambers, 30 and 32, independently of each other.

During operation of the twin-wire press 2 according to FIG. 1, displacement of the wires, 6 and 8, occurs during rotation of the rolls (not shown). The fiber suspension that will be dewatered is fed to an oblong dewatering space 4 through an inlet end 14 thereof. The fiber suspension is dewatered in the dewatering space during displacement of the wires, such that a flow of filtrate from the dewatering space 4 through the wires, 6 and 8, and the perforated dewatering elements, 10 and 12, is formed.

Filtrate that flows from the dewatering space through the wires is collected in the separate chambers, 30 and 32, of the outlet boxes, 18 and 20. The pressure difference between the dewatering space 4 and the chambers, 30 and 32, is adjusted by applying at least a counter-pressure on the portion of the flow of filtrate that is formed on both sides of the upper and lower wires, 6 and 8, directly adjacent to the inlet end 14 of the dewatering space. The magnitude of the counter-pressure is adjusted by the location of the level 28 of the spillway overflow 26. In that respect, a relatively thick, fiber-rich first filtrate can be removed at the inlet end 14 and the build-up of the fiber web, during favourable conditions, can begin almost immediately after feeding into the dewatering space 4.

Figure 2:
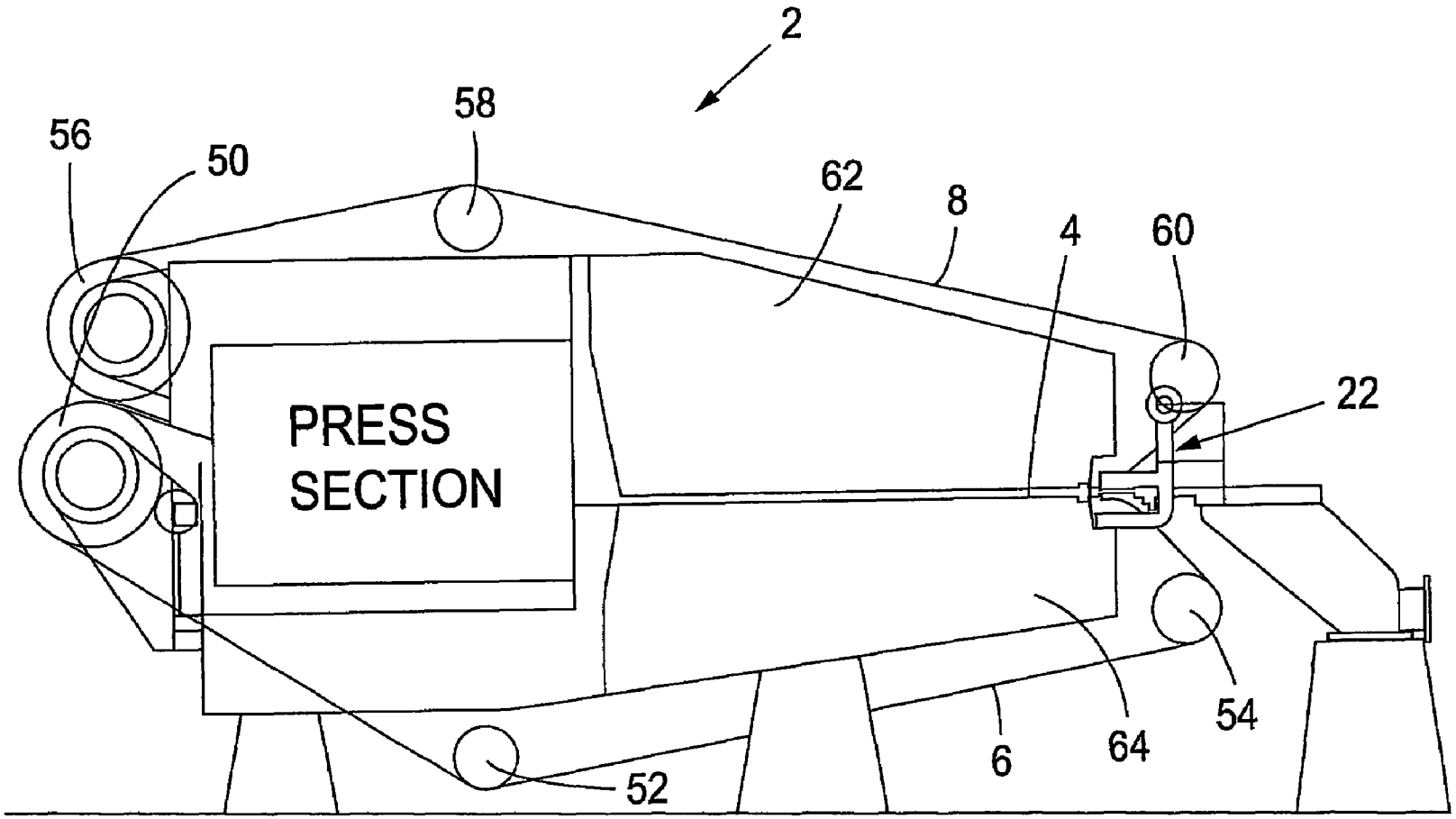
FIG. 2 is a side, elevational, schematic view through the entire twin-wire press according to FIG. 1.

FIG. 2 shows the entire twin-wire press 2 in FIG. 1 according to the present invention. The twin-wire press 2 comprises three lower rolls, more specifically a drive roll 50, a guide roll 52 and a stretch roll 54. The above mentioned (FIG. 1) endless lower wire 6 runs in a path around the lower rolls, 50, 52, and 54. In a corresponding way the above mentioned (FIG. 1) upper endless upper wire 8 runs in a path around three upper rolls, specifically a drive roll 56, a guide roll 58 and a stretch roll 60. An upper dewatering table 62 that supports the upper wire 8, and a lower dewatering table 64 that supports the lower wire 6, forms the dewatering space 4 between the wires, 6 and 8. FIG. 2 also shows the pressure control device 22, that has been described above with reference to FIG. 1. "Press section" in FIG. 2 indicates an ordinary roll arrangement according to the state of the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for dewatering a fiber suspension in a twin-wire press, said method comprising feeding said fiber suspension to an inlet end of an elongated dewatering space defined by an endless lower wire and an endless upper wire, dewatering said fiber suspension in said elongated dewatering space during displacement of said endless lower and upper wires by forming a flow of filtrate from said elongated dewatering space through said endless lower and upper wires, collecting said filtrate in a pair of upper and lower outlet boxes, and adjusting the pressure differential between said elongated dewatering space and each of said pair of upper and lower outlet boxes by controlling the counter-pressure applied to said flow of filtrate on both sides of said endless upper and lower wires directly adjacent to said inlet end of said elongated dewatering space.

2. The method of claim 1 including applying a counter-pressure to said flow of said filtrate at a plurality of separate locations along said elongated dewatering space.

3. The method of claim 2 including independently controlling said counter-pressure at said plurality of separate locations along said elongated dewatering space.

4. A twin-wire press for dewatering a fibrous suspension comprising an endless lower wire and an endless upper wire forming an elongated dewatering space including an inlet and for dewatering said fibrous suspension therebetween, an inlet box for applying said fiber suspension to said inlet end of said elongated dewatering space, a lower perforated dewatering element disposed adjacent to said lower wire on the outer surface thereof, an upper perforated dewatering element disposed adjacent to said upper wire on the upper surface thereof, a lower outlet box for receiving said filtrate flowing from said elongated dewatering space through said elongated lower wire, an upper outlet box for receiving said filtrate flowing from said elongated dewatering space through said elongated upper wire, and a pressure control device for controlling the counter-pressure in said upper and lower outlet boxes in order to adjust the pressure differential between said elongated dewatering space and both said upper and lower outlet boxes at said inlet end of said elongated dewatering space.

5. The twin-wire press of claim 4 wherein said pressure control device comprises a filtrate outlet pipe for receiving the flow of said filtrate from said upper and lower outlet boxes and a spillway overflow disposed at a level above said elongated dewatering space in said filtrate outlet pipe.

6. The twin-wire press of claim 5 wherein said level of said spillway overflow is adjustable.

7. The twin-wire press of claim 4 wherein each of said upper and lower outlet boxes comprises a plurality of chambers for receiving separate portions of said filtrate.

8. The twin-wire press of claim 7 including a plurality of pressure control devices for independently controlling said counter-pressures for each of said plurality of chambers.

9. The twin-wire press of claim 7 including sealing blades extending from said inlet box directly adjacent to said upper and lower perforated dewatering elements including free ends arranged against the inside of said endless upper and lower wires whereby a first filtrate portion is removed from said elongated dewatering space to one of said plurality of chambers of both said upper and lower outlet boxes.

* * * * *